United States Patent [19]

Kovatch

[11] Patent Number: 4,643,477

[45] Date of Patent: Feb. 17, 1987

[54] DEMOUNTABLE WINDSHIELD ARMOR FOR VEHICLES

[75] Inventor: Stephen C. Kovatch, Maineville, Ohio

[73] Assignee: Hess & Eisenhardt Armoring Company, Cincinnati, Ohio

[21] Appl. No.: 832,871

[22] Filed: Feb. 26, 1986

[51] Int. Cl.[4] ..... B60J 9/00

[52] U.S. Cl. ..... 296/84 K; 89/36.14

[58] Field of Search ..... 296/84 K; 89/36.01, 89/36.04, 36.14; 109/78

[56] References Cited

U.S. PATENT DOCUMENTS

| | | | |
|---|---|---|---|
| 2,715,042 | 8/1955 | Lancaster | 296/84 K |
| 2,757,040 | 7/1956 | McLelland | 296/84 K |
| 3,807,791 | 4/1974 | Boyer | 296/84 K |
| 4,336,644 | 6/1982 | Medlin | 89/36.14 |

*Primary Examiner*—Robert R. Song

*Attorney, Agent, or Firm*—Wood, Herron & Evans

[57] ABSTRACT

In an armored vehicle, a plate of transparent armor is mounted just behind the windshield, by mounting means which enable the armor to be slid into position for ease of mounting, and to be moved away from the windshield for cleaning.

9 Claims, 3 Drawing Figures

DEMOUNTABLE WINDSHIELD ARMOR FOR VEHICLES

FIELD OF THE INVENTION

This invention relates to the armoring of vehicles against external attack by gun fire. More particularly, it relates to transparent armor which is mounted behind the windshield.

BACKGROUND

The conventional armored limousine has a heavily armored body and built-in bulletproof windows which are capable of withstanding gun fire at close range. The thickness of the window material and the special requirements for mounting it generally necessitate either a specially built vehicle body or at the very least extensive rebuilding of a standard limousine. These factors add greatly to the cost of the armored vehicle.

More recently, conventional production cars, vans and trucks are being provided with medium duty "add-on" armor protection. This armoring is added to outwardly conventional production vehicles, which are much less obtrusive and identifiable than the specially built limousines. Though reworking of the vehicle body is required, armoring of this type is generally much less expensive than conventional armoring.

In this lighter armoring technique, rather than removing the production windshield and replacing it with bulletproof glass, which as noted above would require very expensive modification, a plate of transparent armor is mounted directly behind and generally parallel to the windshield, which remains in place. The transparent armor is dimensioned so that there is no "gap" or unprotected area around it through which gunfire might be directed into the vehicle.

Similar (although thicker) transparent armor is also used to back up the side and rear glass windows of the vehicle. At these locations the transparent armor is rigidly mounted to the window frames on the inside of the vehicle. Angle brackets are used and the mounting is fairly straightforward, because the frames are easily accessible for mounting. The transparent armor at these locations is not movable, that is, it cannot be rolled down nor can it be swung away to clean the windows.

However, mounting transparent armor behind the windshield presents a more difficult situation. At each side edge the windshield is mounted to the windshield post (also known as the roof support and as the A post) which extends angularly downwardly and which forms an acutely angled corner where it meets the dash panel. It is difficult to secure the transparent armor to the windshield post in the tight space within this actutely angled corner, and it is especially difficult to fit it snugly so that there is no unprotected gap in coverage adjacent the windshield post or the dash.

A further problem in windshield armoring arises in respect to the grime which gradually collects on the windshield. Dust settles in the space between the armor and the windshield (the windshield is typically curved, whereas the armor is a flat plate, so that there is an unsealed gap between them). The proximity of the armor to the windshield has made it almost impossible to clean this space.

Moreover, the armor tends to isolate the windshield from the interior of the vehicle, which makes it difficult to defog the windshield.

In the past the difficulties of mounting the plate of transparent armor behind the windshield have been so formidable that, once installed, it was very difficult to remove the armor. This hindered cleaning the space between the armor and the wind-shield. In one prior mounting technique, the normally flat transparent armor was bowed to effectively narrow it for installation. This required bending the armor with a chain fastened between clamps on the side edges of the armor. Tightening the chain bowed or bent the armor sufficiently to diminish the dimension between its side edges that it could be fitted closely between the windshield posts. Once in place, the armor was permitted to straighten out again and the chain was removed. Obviously that technique was not easily usable; as a practical matter, once the windshield armor had been installed in that manner it was virtually never removed and the opposed, isolated windshield and armor surfaces were never cleaned.

Accordingly, it has been the objective of this invention to provide an improved means of mounting transparent armor behind the windshield whereby the armor can more easily be installed and, once installed, can be moved away from the armor sufficiently that the space between it and the windshield is accessible for cleaning.

BRIEF DESCRIPTION OF THE INVENTION

In accordance with this invention, a plate of transparent armor is mounted in a vehicle by means which permit it to be both pivoted about a transverse axis and moved rearwardly from the windshield. Merely mounting the armor for pivoting movement is insufficient because the lower end of the armor would hit the windshield as the top is swung away from the windshield. To overcome this problem, the mounting means comprises a track or channel which is secured parallel to and along each side edge of the armor. A pivot or wheel is mounted to each windshield post, and rides in this track; in effect the armor is both tiltable about the pivot and translatable along it. The armor can thereby be slid forwardly and down at the same time, for mounting so that it is positioned close behind the windshield. The top edge of the armor is releasably secured above the windshield to the top of the vehicle, by thumbscrews or a latch or the like. When the top edge is released, the armor can be tilted away from the windshield and pulled rearwardly for cleaning.

In installation, the plate of transparent armor, with the channels attached, is engaged on the premounted opposed pivots on each window post, by slipping the channels downwardly over the pivots. The channels or tracks capture the pivots, which can be inserted and released only at the ends of the channels. The upper part of the armor is then tilted upwardly about the pivots so that the armor is roughly parallel to the windshield. It is secured at the top to hold it in this position.

The advantage of these mounting means is that the thick, almost unbendable sheet of transparent armor can be secured close to the windshield and just above the dash, in a position which provides full area protection close behind the windshield, yet it can still be moved away for cleaning.

DESCRIPTION OF THE DRAWINGS

The invention can best be described by reference to the accompanying drawings in which.

DETAILED DESCRIPTION

Figure 2:
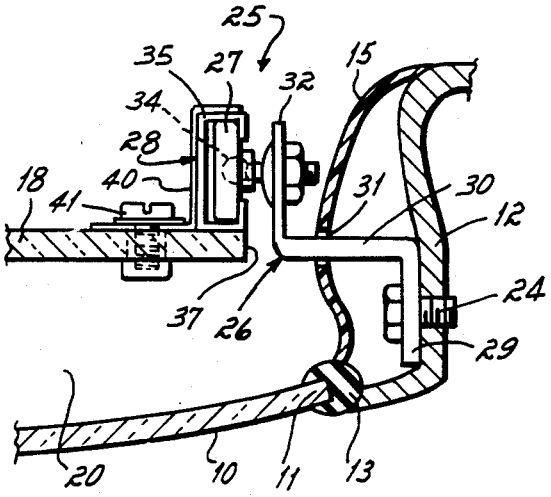
FIG. 2 is an enlarged transverse cross section taken on line 2—2 of FIG. 1.

The drawings show a production or generally standard car body which is provided with transparent windshield armor in accordance with the invention. The vehicle has a conventional (i.e., non-bulletproof glass) windshield 10 which is mounted at each side to windshield posts or roof supports 12. FIG. 2 illustrates only the portion of the supports 12 which is on the inside of the vehicle. A watertight seal or gasket 13 is provided around the side edge 11 of the windshield to prevent water leakage. A textile or molded trim piece 15 covers post 12 on the inside (passenger compartment side) of the post.

The transparent windshield armor designated generally by 18 comprises a flat plate of plastic material which is mounted to the posts at its side edges, as will be described. This material is commercially available under various trademarks, for example that which is sold by General Electric under the trademark "LEXGUARD". The material is supplied in various thicknesses, and typically may be of the order of $\frac{1}{2}''$ thick.

Transparent armor 18 is set rearwardly of the windshield 10, and it can be seen that an interior space 20 is defined behind windshield 10 and in front of transparent armor 18. The distance between the windshield and the armor varies because of the curvature of the windshield, but is of the order of one to five inches.

In order that gunfire cannot pass through the windshield into the interior of the car without encountering the armor, armor 18 must be shaped to fit closely to the dash, roof and window posts.

Dashboard 21 extends forwardly to the windshield and in some vehicles may angle slightly downwardly to the lower edge 22 of the windshield. The lower edge 23 of armor 18 should abut or closely approach the top of the dashboard 21 behind the windshield (see FIG. 3).

As can be seen, the close proximity of the armor to the windshield makes it difficult to secure the armor to the post, especially in the area just above the dash. If the edge gap is to be minimized, there is very little room in which to engage the armor plate with any mounting means.

Figure 3:
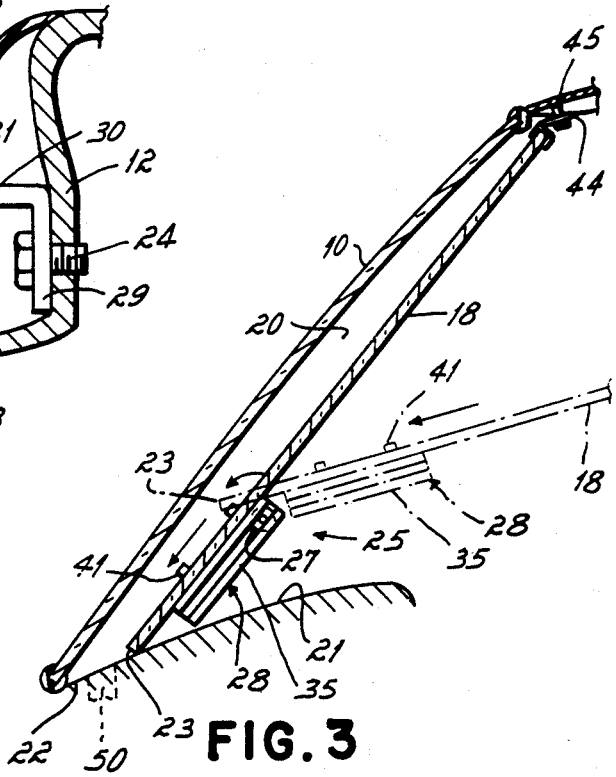
FIG. 3 is a slightly enlarged vertical section taken on line 3—3 of FIG. 1.

The mounting means in accordance with this invention are designated generally as 25 (see FIGS. 2 and 3) and enable the lower portion of the armor to be secured close to the windshield posts just above the dash. The mounting means are similar at each side of the armor; FIGS. 2 and 3 show a single mount.

The mounting means comprise two parts: a windshield post bracket 26 which is fastened to the post 12 (see FIG. 2), and which has a roller, bearing or pivot 27 mounted from it; and an armor track 28 or channel which is mounted to armor 18 and in which the roller 27 is captured.

More specifically, post bracket 26 is preferably Z-shaped in configuration and at its outer end 29 is mounted by one or more screw 24 to post 12. Bracket 26 has an upstanding middle portion 30 which passes through an opening 31 in trim 15. The inside end of bracket 26 presents a roller mounting tab 32, from which roller 27 projects. Roller 27 is preferably a wheel which is rotatable about an axis perpendicular to tab 32 and is preferably journaled, as in the embodiment shown, on a ball head 34 for universal movement. Roller 27 may suitably be made of nylon.

The track or channel 28 in which roller 27 rides comprises a generally C-sectioned channel member 35, which is mounted adjacent the side edge 37 of armor 18. Channel member 35 may be secured by spot welding to the web of a Z-shaped bracket member 40, one end of which is mounted as by a rivet or bolt 41 to the transparent armor 18.

The window post brackets 26 are positioned on the posts approximately $\frac{1}{4}$–$\frac{1}{3}$ of the distance above the dash, but this is not critical. The track 28 can in most cases be installed to the armor before the armor is fitted into place.

To install the armor (shown in dotted lines in FIG. 3), it is slid forwardly and downward toward the windhsield until the channel 35 at each side has received the respective roller 27, so that the roller is captured within the channel. The armor 18 is then pivoted about the axes of the rollers, and is brought into a position nearly parallel to the plane of the windhsield, as shown in FIG. 3. As this occurs the lower end of the armor is moved forwardly and down, as indicated by the arrows, sliding in its plane along rollers 27 until the lower end of the armor is proximate to the dash.

The upper edge of the armor is provided with several tabs 44, one of which is shown at 44 in FIG. 3. Each tab is secured by a thumbscrew to a post or stud 45 on the vehicle interior, so that the armor is secured at both its sides and at the top.

Figure 1:
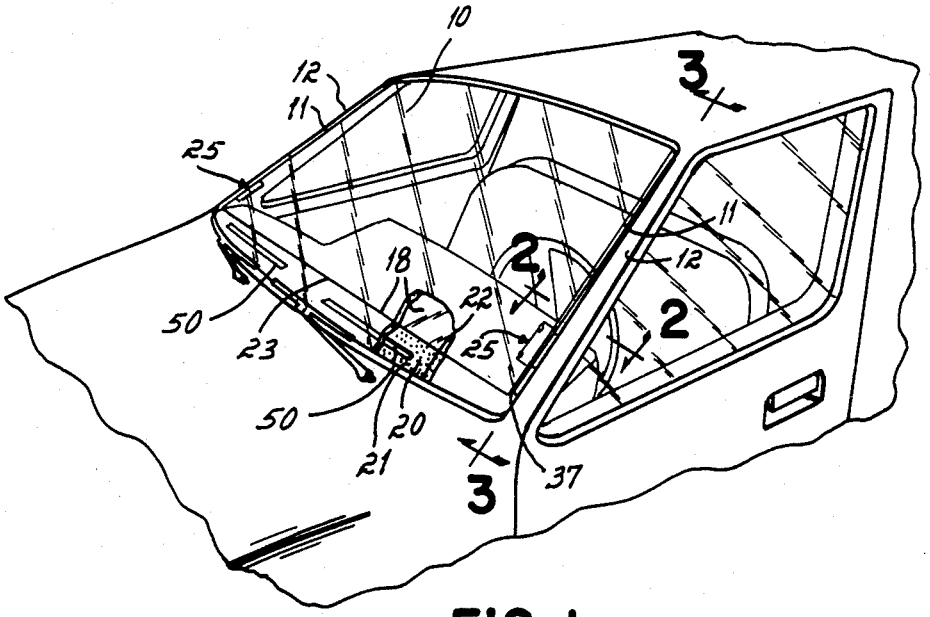
FIG. 1 is a fragmentary perspective view of a four-door sedan provided with windshield armor in accordance with this invention.

It is preferred that, as shown in FIG. 1, the armor is positioned rearwardly of the defogger outlets 50 of the vehicle, so that the defogger discharges air into the space 20, just rearwardly of the windshield but in front of the armor plate. This enables the windshield to be defogged quickly, whereas if the armor were positioned in front of the outlets 50, it would tend to insulate the windshield and would seriously slow the defogging procedure.

As previously explained, over a period of time dust and smoke particles will over time create a film of dirt or haze on the opposed surfaces of gap 20. In order to clean this space the armor can be tilted downwardly, to the dotted line position shown in FIG. 3. This is done by releasing the overhead armor securing means 45, and tilting the armor downwardly about the pivots while at the same time sliding it rearwardly. If the armor were merely rotated about the rollers 27 at each side, its lower edge would strike the windshield which would limit access for cleaning.

In the installation procedure first described the channels are mounted on the armor before the armor is engaged in the rollers. Alternatively, the channels can be engaged on the rollers before they are secured to the armor. The windshield can then be positioned, and the channels secured to the armor by using blind rivets or the like.

Once the pivots have been engaged in the channels, pins may be installed on each end of the channel to retain the roller from disengagement at either end.

From what has been said it should be understood that the relative position of the rollers and channels can be reversed; that is, rollers can be mounted on the armor and channels secured to the windshield posts. At present the construction shown is preferred, however, because the load on the armor is distributed over a wider area, and because it is easier to attach the pivots to the windshield posts than it is to attach the channels to the post.

It can be seen that the means of this invention provides much simpler installation as well as greater ease of cleaning, in comparison to what has been used herebefore.

As used herein the term "vehicle" is meant to include automobiles, trucks, vans, busses, and other automotive machines.

Having described the invention, what is claimed is:

1. In a vehicle having a windshield mounted to a windshield post at each side, windshield armoring comprising, a plate of transparent armor mounted generally parallel to said windshield but spaced rearwardly of it, said armor having side edges generally parallel to the respective windshield posts and a top edge generally parallel to the top of the windshield, each side edge of said armor mounted to the respective windshield post by a mounting means which pivots the armor for rotation about a horizontal axis extending between said posts so that the armor can be tilted relative to the windshield, each mounting means also mounting said armor for movement in the direction transverse to said axis, so that said armor can be moved rearwardly and away from the windshield as it is being tilted about said axis.

2. The windshield armoring of claim 1 wherein each said mounting means comprises a pivot bearing mounted to the respective windshield post and a channel mounted adjacent the side edge of said armor, said channel extending generally parallel to the plane of said armor and receiving said pivot bearing within it, the said pivot bearing being movable along the channel, the channel and armor being pivotable about the pivot bearing.

3. The windshield armoring of claim 2 wherein said channel is secured adjacent the side edge of said armor by a flange which in turn is secured to a face of the armor.

4. The windshield armoring of claim 2 wherein the pivot bearing is captured within the channel.

5. The windshield armoring of claim 4 wherein said pivot bearing is a rotatable roller.

6. The windshield armoring of claim 5 wherein said roller is mounted to the windshield post by a Z-shaped post bracket.

7. The windshield armoring of claim 1 further including releasable means for securing the top edge of said armor to said vehicle.

8. The windshield armoring of claim 1 wherein said mounting means is positioned on the lower portion of said windshield posts, just above the dashboard.

9. The windshield armoring of claim 1 wherein said windshield is curbed and said plate is flat.

* * * * *